US005273478A

United States Patent [19]

Yamasaki

[11] Patent Number: 5,273,478

[45] Date of Patent: Dec. 28, 1993

[54] TOY VEHICLE HAVING MOTOR SOUND

[75] Inventor: Toshio Yamasaki, Long Beach, Calif.

[73] Assignee: Mattel, Inc., El Segundo, Calif.

[21] Appl. No.: 653,565

[22] Filed: Feb. 8, 1991

[51] Int. Cl.[5] ..... A63H 17/34; A63H 29/24

[52] U.S. Cl. ..... 446/409; 446/463; 446/484

[58] Field of Search ..... 446/409, 462, 463, 484, 446/410

[56] References Cited

U.S. PATENT DOCUMENTS

| | | | |
|---|---|---|---|
| 3,080,678 | 3/1963 | Girz . | |
| 3,621,609 | 11/1971 | La Branche . | |
| 3,752,246 | 8/1973 | Sullivan . | |
| 3,908,303 | 9/1975 | McKay et al. . | |
| 4,116,084 | 9/1978 | Masuda . | |
| 4,152,866 | 5/1979 | Suda . | |
| 4,219,962 | 9/1980 | Dankman et al. . | |
| 4,245,427 | 1/1981 | Accornero . | |
| 4,283,879 | 8/1981 | Tsui . | |
| 4,306,375 | 12/1981 | Goldfarb et al. . | |
| 4,459,776 | 7/1984 | Jaworski et al. | 446/462 |
| 4,467,557 | 8/1984 | Kuna et al. | 446/463 |
| 4,475,305 | 10/1984 | Kawakami et al. | 446/463 |
| 4,540,380 | 9/1985 | Kennedy et al. | 446/463 |
| 4,553,947 | 11/1985 | Weiland et al. | 446/443 |
| 4,573,943 | 3/1986 | Kennedy et al. | 446/463 |
| 4,580,994 | 4/1986 | Fauser et al. | 446/462 X |
| 4,911,669 | 3/1990 | Parker | 446/484 X |
| 4,946,416 | 8/1990 | Stern et al. | 446/409 |
| 4,976,650 | 12/1990 | Watanabe | 446/463 X |

FOREIGN PATENT DOCUMENTS

| | | | |
|---|---|---|---|
| 1198263 | 8/1965 | Fed. Rep. of Germany | 446/409 |
| 1287488 | 1/1969 | Fed. Rep. of Germany | 446/409 |

*Primary Examiner*—Mickey Yu
*Attorney, Agent, or Firm*—Roy A. Ekstrand

[57] ABSTRACT

A toy vehicle includes a generally rectangular hollow supporting chassis and a replica vehicle body pivotally secured to the chassis at the front portion. A return spring resiliently biases the rear portion of the truck body in a generally horizontal position. A battery power unit and electric motor are supported within the vehicle chassis and coupled to the vehicle wheels by a gear coupling mechanism. The gear coupling mechanism is engageable and disengageable by a shift lever extending upwardly from within the vehicle chassis to beyond the vehicle body. A sound unit includes a sound drum and a flexible reed supported closely thereto. A plurality of extending tabs within the drive gear system are operative upon motor rotation to flex and release the spring reed against the drum head sound unit to produce engine sounds. A heavy flywheel is coupled to the motor drive system and produces gradual slowdown when the motor is disengaged. An electric switch is interposed between the battery power unit and the motor and is operable by either pivotal motion of the truck body when the user presses downwardly upon or by the positioning of the shift lever in the engaged position.

6 Claims, 3 Drawing Sheets

TOY VEHICLE HAVING MOTOR SOUND

FIELD OF THE INVENTION

This invention relates generally to toy vehicles and particularly to those having engine sound producing mechanisms.

BACKGROUND OF THE INVENTION

One of the more long lasting and exciting types of toys provided for use by young people is generally described as miniature toy vehicles. Such toy vehicles come in a virtually endless variety of shapes, sizes and configurations with most replicating one or more of the vehicles normally used. In certain types of toy vehicles, additional realism is provided by including sound producing mechanisms which provide engine sounds similar to those produced by actual operational vehicles.

One such sound producing toy vehicle is set forth in U.S. Pat. No. 3,080,678 issued to Girz which sets forth a VEHICULAR TOY WITH ACOUSTIC SIGNAL in which a toy vehicle includes a plurality of sound producing or musical devices including a simulated horn or siren. The sound producing devices are operatively coupled to switching means which in turn are controllable by the vehicle steering wheel.

U.S. Pat. No. 3,621,609 issued to LaBranche sets forth a SPRUNG AXLE ASSEMBLY AND METHOD FOR TOY VEHICLES in which a toy vehicle includes a supporting chassis having a pair of suspended axles. An elongated generally planar beam spring is secured at the proximate midpoint of the vehicle chassis and resiliently supports the two transverse axles.

U.S. Pat. No. 3,752,246 issued to Sullivan sets forth a RACING CAR HAVING A RESILIENT SUSPENSION SYSTEM which is adjustable. The vehicle wheels are permitted to flex substantially independently of each other with a positive control provided for the amount of flexibility of each wheel. Means are provided for supporting the vehicle drive motor in a desired operating position.

U.S. Pat. No. 3,908,303 issued to McKay, et al. sets forth a SHIFT CONSOLE INCLUDING MEANS FOR FEEDING AND LAUNCHING VEHICLES which includes a launching station having a plunger-like launcher member for striking and launching a vehicle positioned at the station. A simulated gear shift lever connected to the plunger is used to operate the launching mechanism.

U.S. Pat. No. 4,116,084 issued to Masuda sets forth a MOVABLE TOY HAVING GEAR DISENGAGING MECHANISM AND GEAR CHANGING MECHANISM for use in a movable toy. The system disengages automatically between gears. Operational means provide for automatic release of an engaged gear in the event the driven side is forcibly stopped.

U.S. Pat. No. 4,152,866 issued to Suda sets forth an ELECTRICALLY DRIVEN TRAVELING TOY in which a transmission mechanism is disengaged through a manually operated changeover means from the driving power source when the energization of the power source is interrupted. The transmission mechanism is manually operated through a pivotable lever.

U.S. Pat. No. 4,219,962 issued to Dankman, sets forth a TOY VEHICLE having means for generating an engine sound simulation. The sound producing means further include means for producing a range of sounds through different gear ratios, squealing tires, and a crash. Means are also provided for simulated siren noises.

U.S. Pat. No. 4,245,427 issued to Accornero sets forth a TOY VEHICLE WITH NOISE MAKER which includes a closed rectangular resonating chamber and a hard flexible diaphragm forming the upper chamber surface. An idler wheel in the gear train between the vehicle's electric motor and the driven rear wheels has cam profiles mounted on its surface. A hammering pin extending through a rigid chamber wall rides on the cam and alternatively flexes and releases the diaphragm. The released diaphragm impacts a rigid stop causing diaphragm oscillations and a resonating sound within the chamber. The sound is produced twice with each revolution of the idler wheel.

U.S. Pat. No. 4,283,879 issued to Tsui sets forth a TOY VEHICLE WITH FOUR WHEEL DRIVE having a chassis supporting a pair of parallel spaced axles with wheels fixed to the outer ends thereof. A motor connected to the axles includes an inertia flywheel and gear trains extending between the shaft and the axles so as to drive both axles unidirectionally and simultaneously provide for wheel drive.

U.S. Pat. No. 4,306,375 issued to Goldfarb, et al. sets forth a SELF-POWERED FOUR WHEEL DRIVE VEHICLE having a battery powered motor and a pair of pinion drive shafts coupled through gear mechanism to four drive wheels supporting the vehicle chassis.

U.S. Pat. No. 4,459,776 issued to Jaworski, et al. sets forth a MOTOR DRIVEN WHEELED TOY WITH FLOATING DRIVEN AXLE having six support wheels and an internal motor drive system. A plurality of pinion gears are supported upon a common driven shaft coupled to the drive motor. Gear means couple each of the pinions to a respective one of the supporting vehicle axles.

U.S. Pat. No. 4,467,557 issued to Kuna, sets forth a SHIFTABLE DRIVE SELF-PROPELLED TOY VEHICLE having a battery powered electric motor drive and a projecting shift lever extending upwardly from the vehicle. The shift lever is movable through a conventional shift pattern for operating transmission means which couple the drive motor to the axle in a variety of gear ratios. U.S. Pat. No. 4,475,305 issued to Kawakami, et al. sets forth a TOY VEHICLE WITH INERTIA WHEEL having an inertia type flywheel, a gear train driving mechanism and a sound generator supported within a vehicle body. The flywheel is coupled to the drive mechanism bought by a detachable clutch gear and continues to rotate when the wheels are stopped and the clutch is in neutral. The sound generator produces a siren sound as the flywheel rotates.

U.S. Pat. No. 4,540,380 issued to Kennedy, et al. sets forth a TOY VEHICLE HAVING VARIABLE DRIVE powered by a single battery operated motor and having a shiftable transmission coupling the motor to the drive wheels. A gear shift lever operates the transmission means and extends upwardly through a slot in the toy vehicle body.

U.S. Pat. No. 4,453,947 issued to Weiland, et al. sets forth a SHIFTING MECHANISM FOR MOTORIZED TOY in which a toy vehicle includes an electric motor and electric power supply. A gear train connects the electric motor to an output shaft and a shift mechanism is connected to an upwardly extending shift lever such that the movement of the shift lever shift certain of the keys within the gear train to control the speed of the output shaft and the vehicle.

U.S. Pat. No. 4,573,943 issued to Kennedy, et al. sets forth a MOTORIZED TOY VEHICLE propelled by a bidirectional miniature DC motor coupled by a clutch through a gear train to a wheel axle. A manually operated shift stick mechanism is operatively linked both to the clutch and to the polarity reversing switch coupled to the motor and the battery.

U.S. Pat. No. 4,946,416 issued to Stern, et al. sets forth a VEHICLE WITH ELECTRONIC SOUNDER AND DIRECTION SENSOR which is operable by being pushed along by a child user. Electronic circuitry capable of emitting a plurality of different sounds such as those produced by a full size truck are supported within the vehicle chassis.

While the foregoing described prior art devices have provided various toy vehicles including, in some instances, sound producing devices, there remains a continuous need in the art for evermore realistic and exciting sound producing toy vehicles.

SUMMARY OF THE INVENTION

Accordingly, it is a general object of the present invention to provide an improved toy vehicle. It is a more particular object of the present invention to provide an improved toy vehicle having realistic sound producing apparatus. It is a still more particular object of the present invention to provide an improved toy vehicle having realistic sound producing apparatus which is operated in a more exciting realistic manner.

In accordance with the present invention, there is provided a toy vehicle comprises: a chassis defining an interior cavity and having a pair of axles; a vehicle body; attachment means pivotally attaching the body to the chassis; spring means resiliently biasing the body toward a first position; an electric motor having an inertial flywheel coupled thereto and rotatable when the motor is energized; gear drive means coupling the motor to at least one of the axles; shift means for engaging and disengaging the gear drive means coupling; switch means for energizing the motor; and engine sound means coupled to the inertial flywheel producing an engine sound as the flywheel rotates.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
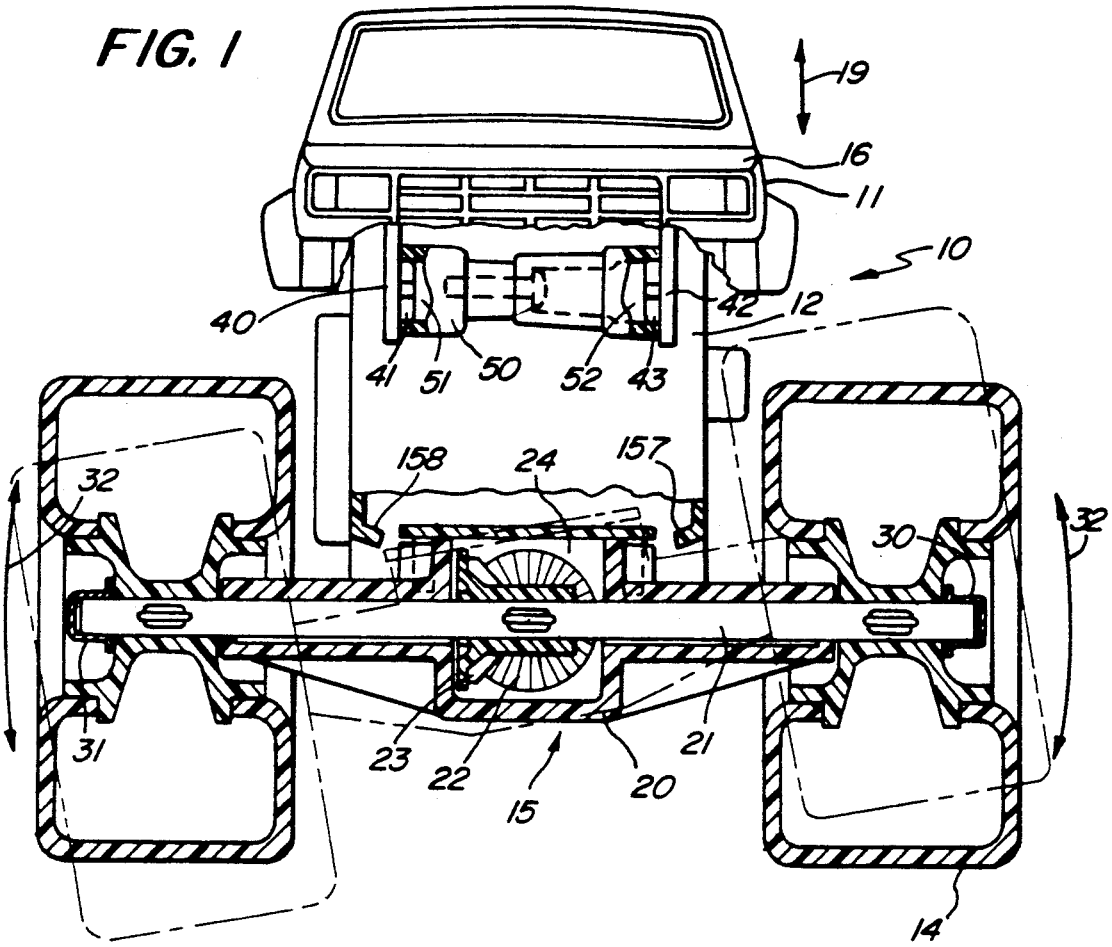
FIG. 1 sets forth a partial section of a toy vehicle constructed in accordance with the present invention.

FIG. 1 sets forth a section view of a toy vehicle constructed in accordance with the present invention and generally referenced by numeral 10. Vehicle 10 includes a truck body 11 configured generally to replicate a conventional pick-up truck and having a forwardly extending hood portion 16. Truck body 11 defines a generally closed upper surface including a rearwardly extending truck bed 17 (seen in FIG. 2). Truck body 11 is generally open on its underside and includes a pair of downwardly extending generally planar support members 40 and 42. Support 42 defines an inwardly extending flanged boss 41 while support 42 defines an inwardly extending flanged boss 43.

Vehicle 10 further includes a generally rectangular chassis 12 which includes a generally cylindrical support member 50 having a pair of recesses 51 and 52 defined at the outer portions thereof. In accordance with the invention, truck body 11 is pivotally secured to chassis 12 by the captivation of support members 40 and 42 against the outer portions of support 50 and by the extension of flanged bosses 41 and 43 into recesses 51 and 52 respectively. Thus, truck body 11 is pivotally secured to chassis 12 by the cooperation of support 50, recesses 51 and 52 and supports 40 and 42 together with flanged bosses 41 and 43.

Vehicle 10 further includes a front axle assembly generally referenced by numeral 15 which includes an elongated axle housing 20 defining a center cavity 24. A pair of drive gears 22 and 23 are rotatably supported within cavity 24 of axle 15. As is better seen in FIG. 2, gear 22 is coupled to the rear wheels of vehicle 10 while gear 23 is secured to a transversely extending front axle shaft 21. The outer ends of shaft 21 receive a pair of attached front wheels 13 and 14. A pair of lock members 30 and 31 secure wheels 14 and 13 respectively to front axle shaft 21. Thus, axle shaft 21, gear 23 and front wheels 13 and 14 are mutually secured in a rotatable attachment. As is set forth below in greater detail, gear 22 is driven by motor 70 (seen in FIG. 2) to rotate gear 22 against gear 23 and provide for powered rotation of front wheels 13 and 14. In addition, axle housing 20 is pivotally secured to chassis 12 in the manner set forth below in greater detail to permit axle 15 and front wheels 13 and 14 to move pivotally with respect to chassis 12 in the manner indicated by arrows 32.

Figure 2:
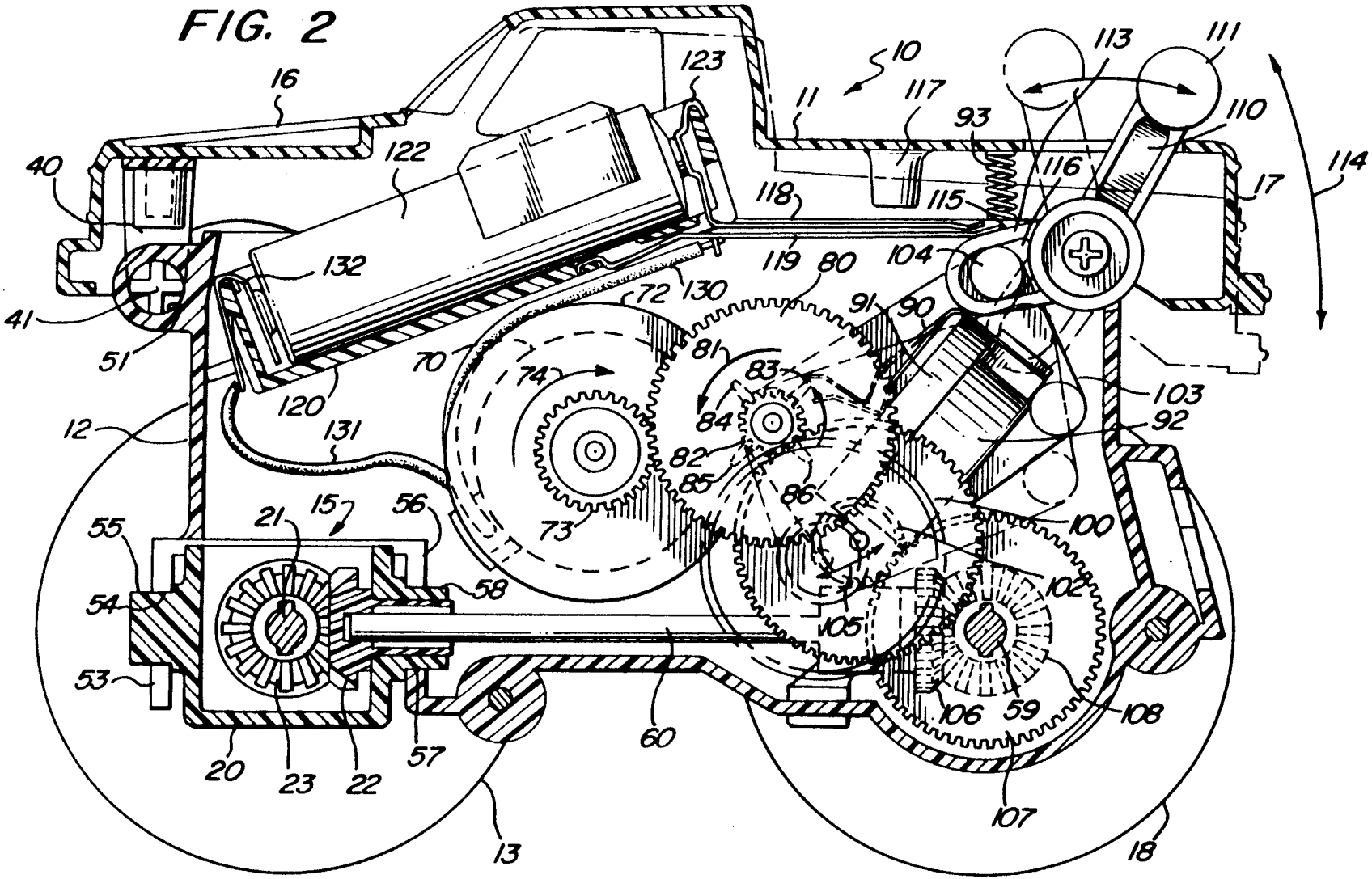
FIG. 2 sets forth a section view of the present invention toy vehicle taken along section lines 2—2 in FIG. 1.

FIG. 2 sets forth a section view of the present invention toy vehicle generally referenced by numeral 10. Vehicle 10 includes a truck body 11 defining a forwardly extending hood 16 and a rearwardly extending truck bed 17. Truck body 11 further includes a downwardly extending support 40 having an inwardly extending flange boss 41. Truck body 11 further defines a downwardly extending interior post 117. Vehicle 10 further includes a generally rectangular hollow chassis 12 defining a pair of downwardly extending support members 53 and 56. Support members 53 and 56 define a pair of apertures 54 and 57 respectively. A front axle 15 includes an axle housing 20 having a forwardly extending bearing 55 which is received within aperture 54 of support 53. Axle housing 20 further includes a rearwardly extending bearing 58 which is received within aperture 57 of support 56. Thus, as described above, axle housing 20 pivotally supports axle assembly 15 upon the lower portion of chassis 12. A front axle shaft 21 extends transversely through axle assembly 15 as is better seen in FIG. 1 and supports an attached gear 23. A drive shaft 60 supports a gear 106 at its rear end and a gear 22 at its forward end. Gear 22 engages gear 23 in an operative coupling which permits drive shaft 60 by means set forth below in greater detail to couple operative power to shaft 21 of axle assembly 15.

Figure 3:
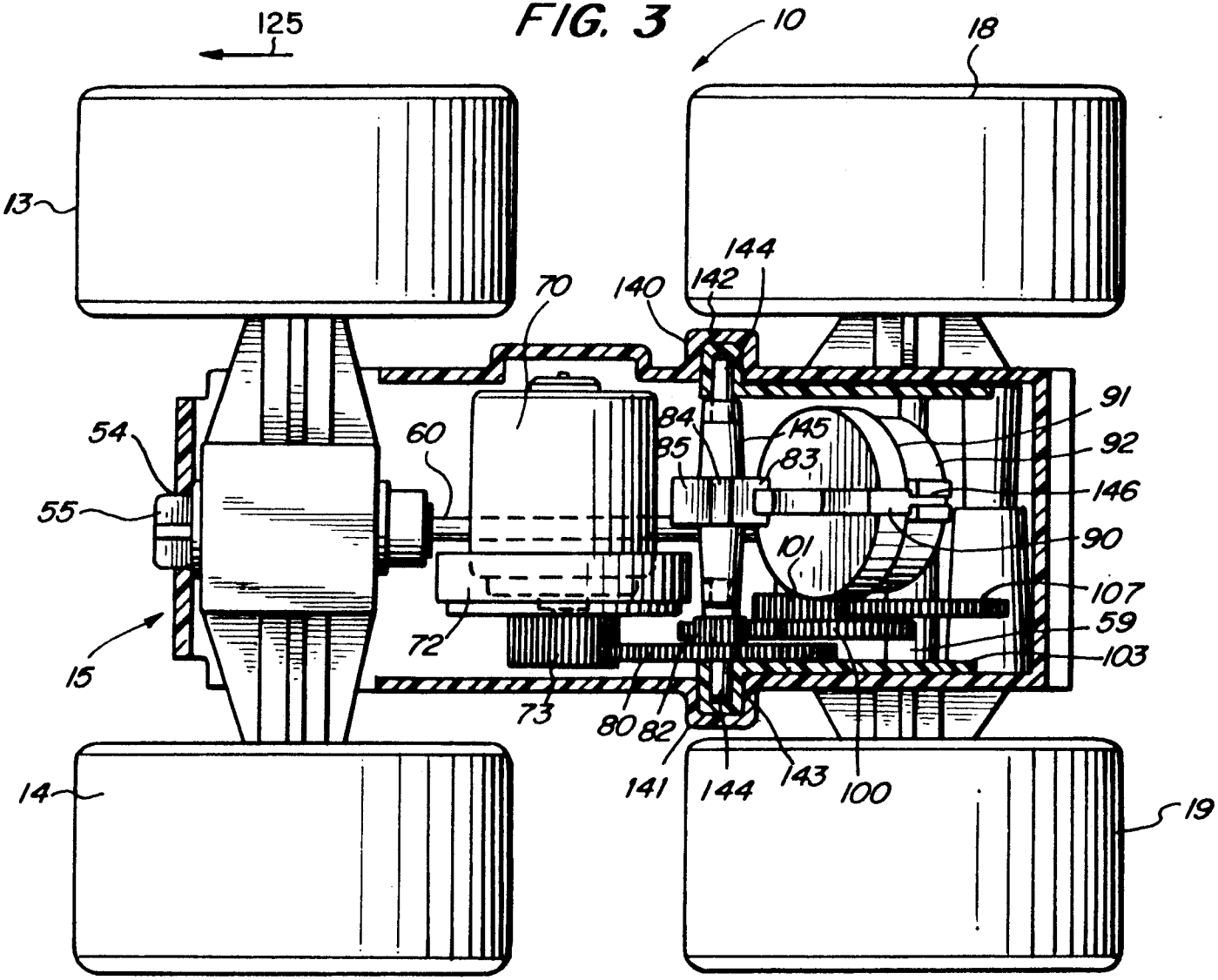
FIG. 3 sets forth a partially sectioned toy view of the present invention toy vehicle.

As is better seen in FIG. 3, vehicle 10 further includes a pair of rear wheels 18 and 19 rotatably supported upon chassis 12 by a rear axle 59. Rear axle 59 extends transversely through the rear lower portion of chassis 12 and supports wheels 18 and 19 in an attachment similar to that shown for front wheels 13 and 14 using lock members (not shown) which are generally similar to lock members 30 and 31 secured to front shaft 21.

A battery support case 120 is supported within chassis 12 and receives and supports a plurality of conventional batteries 22. A contact 32 is secured to the lower portion of battery case 120 and provides electrical contact with one pole of batteries 122. A contact 123 is secured to the upper portion of battery case 120 and provides electrical contact to the remaining pole of batteries 122. Contact 123 further defines an elongated generally flat reed member 118 extending rearwardly from contact 123 and passing beneath post 117 of truck body 11. An elongated reed 119 is secured to the lower portion of battery case 120 and extends generally parallel to and spaced from reed 118. Reeds 118 and 119 are preferably formed of a metallic spring material and, in their normal unflexed positions, remain separated and out of contact. In the position shown in FIG. 2, however, by means set forth below in greater detail, reeds 118 and 119 are forced into a contacting position and are thus shown in FIG. 2.

An electric motor 70 is supported within the interior of chassis 12 and includes an outwardly extending output shaft 71. A pair of connecting wires 130 and 131 provide electrical connections to reed 119 and contact 132 respectively. Motor 70 may comprise virtually any conventional DC motor which is energized by the establishment of contact between reeds 118 and 119. Thus, the contact of reeds 118 and 119 completes the electrical circuit which couples electrical power from batteries 122 to electric motor 70 causing output shaft 71 to be rotated in the direction indicated by arrow 74. Conversely, the separation of reeds 118 and 119 interrupts the electrical circuit coupling power from batteries 122 to motor 70.

In accordance with an important aspect of the present invention, an inertia flywheel 72 is secured to and supported by output shaft 71 of motor 70. Flywheel 72 is preferably formed of a heavy metallic or metal material and defines an outwardly extending gear 73. In its preferred form, flywheel 72 is of sufficient weight to substantially overcome the frictional forces within motor 70 such that the energizing of motor 70 stores energy within flywheel 72 permitting the rotation thereof for a substantial period of time following the interruption of electrical power coupling to motor 70. A gear 80 is rotatably supported upon chassis 12 by conventional means not shown and is operatively coupled to gear 73. As a result, rotation of gear 73 in the direction indicated by arrow 74 causes gear 80 to be rotated in the direction of arrow 81. Gear 80 further supports a gear 82 and a plurality of radially extending tabs 83, 84, 85 and 86. A gear carriage 103 is pivotally supported within chassis 12 by means better seen in FIG. 3. Suffice it to note here, however, gear carriage 103 is pivotable about an axis concentric with the center of gears 80 and 82. A gear 100 is rotatably supported upon gear carriage 103 and engages gear 82. Gear 100 further supports a gear 101 in a concentric relationship. Gear carriage 103 further supports a generally cylindrical hollow closed end sound drum 92 and a flexible resilient drum head 91. Drum head 91 is secured to sound drum 92 such that an acoustical coupling takes place therebetween. In its preferred form, drum head 91 is formed of a resilient material producing a sharp sound when struck. A spring material reed 90 is secured to and supported by gear carriage 103. Reed 90 extends inwardly across a substantial portion of drum head 91 and terminates within the travel path of rotating tabs 83 through 86. The extension of reed 90 into the travel path of tabs 83 through 86 during rotation causes reed 90 to be bent outwardly from drum 91 as one of tabs 83 through 85 pass beneath the end portion thereof. In the position shown in FIG. 2, tab 83 has completed its rotational travel beneath reed 90 flexing reed 90 outwardly to the position shown. As tab 83 continues in the direction indicated by arrow 81, reed 90 is released and, due to its resilient spring character, snaps inwardly striking drum head 91 and producing a sound which is acoustically enhanced by sound drum 92. The outward flexing and release of reed 90 continues each time one of tabs 83 through 86 passes beneath the end portion of reed 90. Thus, as tabs 83 through 86 rotate, reed 90 is caused to rapidly strike drum head 91 in a repeated sound producing fashion.

Gear carriage 103 further defines a generally cylindrical post 104. A shift lever 110 having a generally L-shaped structure is pivotally secured to chassis 12 by a pivot 112. Shift lever 110 includes a handle 111 extending upwardly beyond the upper surface of truck bed 17. Shift lever 110 further includes an arm 115 defining an elongated slot 116. Post 104 of gear carriage 103 extends through and is received within slot 116. Thus, pivotal motion of shift lever 110 in the direction indicated by arrows 113 causes gear carriage 103 to be pivoted about gears 80 and 82 in the direction indicated by arrow 105 between the solid line representation and dashed line representations shown in FIG. 2. In accordance with an important aspect of the present invention, the pivotal motion of gear carriage 103 moves gear 101 in the manner indicated by arrows 105. Thus, with shift lever 110 in the positions shown in FIG. 2, gear carriage 103 is pivoted about gears 80 and 82 to the position shown in solid line representation. As a result, gear 101 and gear 100, which are carried by gear carriage 103, are moved to the position shown in which gear 100 engages gear 82 and in which gear 101 engages gear 107. This position defines the engaged position of the gear system of vehicle 10. When the gear system and shift lever 110 is positioned as shown, arm 115 forces reed 119 upwardly against reed 118 completing the battery power circuit in the above-described manner for motor 70. Thus, motor 70 is engaged and flywheel 72 and output shaft 71 are rotated in the direction indicated by arrow 74. The engagement of gears 73 and 80 cause gears 80 and 82 to be rotated in the direction indicated by arrow 81. The engagement of gear 100 with gear 82 causes gear 100 and gear 101 to be rotated. The engagement of gear 107 with gear 101 causes a rotation of gear 107 which, as mentioned above, is secured to rear axle 59 thereby driving rear wheels 18 and 19 and propelling vehicle 10. In addition, the rotation of gear 107 causes a corresponding rotation of gear 108. This rotational force is coupled by gear 106 and drive shaft 60 to gears 22 and 23 of front axle assembly 15 which in turn produces powered rotation of front axle shaft 21. This in turn causes powered rotation of front wheels 13 and 14.

Conversely, if shift lever 110 is moved forwardly to the disengaged position shown for handle 111 and shift lever 110 indicated in dashed line representation in FIG. 2, a corresponding pivotal motion is produced in arm 115 which carries or pivots gear carriage 103 in a clockwise rotation about gears 80 and 82. With gear carriage 103 in the dashed line position shown, gears 100 and 101 are carried to the clockwise position shown in dashed line representation. In this position, gear 100 remains engaged with gear 82 due to the concentric support of gear carriage 103 and gear 82. However, the pivoting motion of gear carriage 103 moves gear 101 away from engagement with gear 107. As a result, the power coupling between motor 70 and the vehicle wheels is interrupted and no powering of vehicle 10 results. In addition, the pivotal motion of shift lever 110 and arm 116 also releases the upward pressure upon flexible reed 119. In the absence of this upward pressure, reed 119 returns to its normal shape in which reeds 18 and 19 are separated. As a result, the energizing of motor 70 by batteries 122 is also interrupted and motor 70 remains inoperative. Thus, movement of shift lever 110 between the engaged position shown in solid line representation and the disengaged position shown in dashed line representation selectively engages or disengages the power coupling from motor 70 to wheels 13, 14, 18 and 19 and interrupts or completes the energizing of motor 70.

As can be seen, post 117 of truck bed 11 extends downwardly above reeds 118 and 119. A return spring 93 is supported between the upper edge of chassis 12 and the underside of truck bed 17. Return spring 93 biases or positions truck body 11 to the normal solid line position shown in FIG. 2. When so positioned, post 117 remains out of contact with reeds 118 and reed 119. In accordance with an important aspect of the present invention, however, a downward force applied to truck body 17 sufficient to overcome return spring 93 causes truck body 11 to pivot about recess 51 of chassis 12. This pivotal motion forces post 17 downwardly against reed 118 causing reed 118 to be flexed downwardly into contact with reed 119. The contact between reeds 118 and 119 completes the above-described electrical connection between batteries 122 and motor 70. As a result, motor 70 is energized causing output shaft 71 to turn which in turn rotates flywheel 72 in the direction indicated by arrow 74. With shift lever 110 in the forward or disengaged position shown in dashed line representation, the gear coupling between motor 70 and wheels 13, 14, 18 and 19 of vehicle 10 is interrupted in the manner described above. However, the rotation of motor 70 rotates flywheel 72 nonetheless. Concurrently, the rotation of motor 70 produces a corresponding rotation of gears 80, 82, 100 and 101. However, gear 107 remains unmoved due to the disengagement of gear 101 and 107 by the positioning of shift lever 110 in the disengaged or forward position.

In accordance with an important aspect of the present invention, the downward pivotal motion of truck body 11 completing the electrical circuit for motor 70 causes flywheel 72 to rotate rapidly producing the rotation of gear 80 and moving tabs 83 through 86 against reed 90. Thus, each time truck body 11 is pushed downwardly driving reeds 118 and 119 together, the above-described motor sound is produced due to the rapid flexing and release of reed 90 against drum head 91. Thus, each time truck body 11 is pushed downwardly, the sound mechanism of vehicle 10 produces an engine replicating sound. In accordance with an important aspect of the present invention, the inertia of flywheel 72 causes motor 70, gear 80 and tabs 83 through 86 to continue to move and gradually slow down each time truck body 11 is released and returned to its upright position by spring 93. This produces a more realistic engine revving sound as truck body 11 is repeatedly pushed down producing an increasing speed sound as motor 70 begins to increase revolutions and a rundown or slowdown sound as truck body 11 is released and flywheel 72 slows gradually producing a rundown or slowing sound as the flexing and release of reed 90 is gradually slowed. The result is a sound which very closely replicates engine revving and slowdown each time truck body 11 is depressed and released.

In operation, vehicle 10 is positioned having shift lever 110 in its forward or disengaged position. When so positioned, the above-described engine revving sound is produced as truck body 11 is depressed and released causing it to pivot in the directions indicated by arrows 114. As truck body 11 continues to be pivoted and released, the child user obtains the desired engine revving sound so characteristic of competition vehicles at the starting line as their drivers rev the engines. In further accordance with realistic play activity, the user quickly learns to further duplicate competitive racing and other competition activities by timing the downward pressure upon truck body 11 to achieve peak revolutions of motor 70 and time the pivotal motion of shift lever 110 from the disengaged position to the engaged position. As mentioned above, the movement of shift lever 110 to the engaged position completes the gear coupling from motor 70 to wheels 13, 14, 18 and 19 and maintains closure of the power circuit for motor 70. As a result, the user quickly learns to maintain the downward pressure upon truck body 11 until the desired engine sound is obtained and thereafter quickly shift lever 110 to the engaged position producing rapid acceleration and forward motion of vehicle 10. Once shift lever 110 has moved to the engaged position, the release of vehicle 10 permits the forward motion under power of vehicle 10 while the engine sound continues due to the continued flexing and release of sound reed 90 against drum head 91 and sound drum 92.

FIG. 3 sets forth a top partially sectioned view of vehicle 10. As described above, chassis 12 defines a generally rectangular hollow member having an aperture 54 supporting a front axle unit 15 in the pivotal attachment described above. In addition, chassis 12 supports axle shaft 59 extending transversely therethrough and coupled to gear 108 (seen in FIG. 2). Wheels 18 and 19 are supported by and coupled to axle shaft 59 while wheels 13 and 14 are supported by and coupled to axle shaft 21 (seen in FIG. 2). A drive shaft 60 is coupled between rear axle shaft 59 and front axle unit 15 in the manner described above. Chassis 12 further defines a pair of outwardly extending recesses 140 and 141. A gear carriage 103 is positioned within chassis 12 and defines a pair of outwardly extending generally cylindrical bosses 142 and 143 which are received within recesses 140 and 141 respectively. The extension of bosses 142 and 143 into recess 140 and 141 provides the above-described pivotal support for gear carriage 103. By conventional attachment means, gear carriage 103 supports a generally cylindrical sound drum 92 having a resilient drum head 91 extending across the top portion thereof. Sound drum 92 further defines a slot 146 which receives one end of a resilient flexible reed 90. The remaining end of reed 90 extends above and away from drum head 91 as is better seen in FIG. 2. A shaft 144 is received within bosses 142 and 143 of gear carriage 103. A gear 80 which includes a smaller diameter integral gear 82 is rotatably supported upon shaft 144. A tab support 145, defining a generally cylindrical hollow member, is secured to and supported by shaft 144. Tab support 145 further includes a quartet of radially extending tabs 83 through 86. Thus, gears 80 and 82 and tab support 45 are secured to and rotatable with shaft 144.

An electric motor 70 is supported within the interior of chassis 12 by conventional support means not shown. A heavy inertial flywheel 72 is coupled to the output shaft of motor 70 and includes an integral gear 73 concentric therewith. Motor 70 is supported such that gear 73 engages gear 80 in a fixed engagement. A gear 100 is rotatably supported by conventional means not shown on gear carriage 103 and includes an integral reduced diameter gear 101. Gear 100 is supported by gear carriage 103 to provide engagement of gear 100 with gear 82. A gear 107 is supported upon and secured to axle shaft 59 and is not moved with gear carriage 103. Thus, the above-described pivotal motion of gear carriage 103 produced by shift lever 110 produces relative motion between gears 101 and 107 to provide engagement and disengagement therebetween.

In accordance with the operation described above, the energizing of motor 70 produces rotation of flywheel 72 and gear 73. This in turn produces rotation of gears 80 and 82, tab support 145 and tabs 83 through 86. The rotation of tab support 145 and tabs 83 through 86 causes the flexing and release of reed 90 against drum head 91 producing the above-described engine sounds. In addition, the rotation of gear 82 causes a corresponding counter direction rotation of gear 100 and gear 101. In the event shift lever 110 (seen in FIG. 2) is in the forward or disengaged position, the pivotal position of gear carriage 103 removes gear 101 from engagement with gear 107. As a result, no power coupling occurs between gears 101 and 107 and vehicle 10 is not powered. However, the above-described engine sound production takes place and the engine revving sounds may be readily produced by depressing truck body 11.

Conversely, in the event shift lever 110 (seen in FIG. 2) is moved rearwardly in the engaged position, gear 101 is brought into engagement with gear 107 by the pivotal motion of gear carriage 103 causing vehicle 10 to be driven forwardly in the direction of arrow 125.

Figure 4:
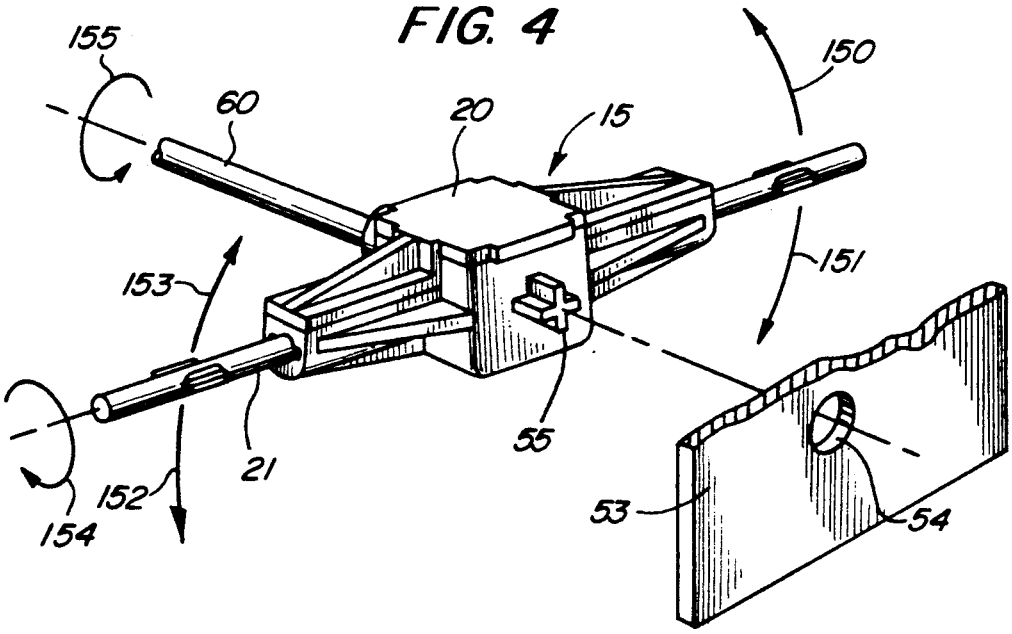
FIG. 4 sets forth a partially sectioned perspective view of a portion of the drive mechanism of the present invention toy vehicle.

FIG. 4 sets forth a perspective view of the front axle unit of the present invention toy vehicle. Support 53 extends downwardly from chassis 12 (seen in FIG. 2) and defines an aperture 54. Front axle unit 15 includes a housing 20 supporting gears 22 and 23 (also seen in FIG. 2). Front axle shaft 21 extends transversely through and is rotational within axle housing 20. Drive shaft 60 extends forwardly from the above-described gear train and engages the gear coupling within axle housing 20. Axle housing 20 further defines a flanged bearing 55 which is received within and supported by aperture 54 of support 53. When so assembled, front axle unit 15 is pivotable by the rotation of bearing 55 within aperture 54. Thus, pivotal motion of front axle 15 permits axle shaft 21 (and wheels 13 and 14 seen in FIG. 1) in the counterclockwise direction shown by arrows 150 and 152 and in the clockwise direction shown by arrows 151 and 153. The cooperation of bearing 55 and aperture 54 maintains the position of front axle unit 15. The gear coupling within axle 20 permits rotation of drive shaft 60 in the direction of arrow 155 to produce a corresponding forward motion rotation of axle shaft 21 in the direction of arrow 154.

Thus, the pivoting front axle configuration of axle housing 20 within support 53 provides a realistic suspension activity as vehicle 10 encounters obstacles. The pivotal motions of front axle 15 are limited in the counterclockwise direction by a stop 157 and in the clockwise direction by a stop 158. Stops 157 and 158 are formed in chassis 12 and better seen in FIG. 1.

What has been shown is an exciting and realistic toy vehicle which provides realistic engine revving sounds and easily operated power coupling to engage and disengage the drive system of the toy vehicle. The use of a heavy flywheel together with the drive motor coupled to the sound unit produces realistic engine revving and rundown sounds characteristic of competition engines.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy vehicle comprising:

a chassis defining an interior cavity and having a pair of axles;

a vehicle body;

attachment means pivotally attaching said body to said chassis;

spring means resiliently biasing said body toward a first position;

an electric motor having an inertial flywheel coupled thereto and rotatable when said motor is energized;

gear drive means coupling said motor to at least one of said axles;

shift means for engaging and disengaging said gear drive means coupling between said motor and said at least one of said axles;

switch means for energizing said motor; and engine sound producing means coupled to said inertial flywheel producing an engine sound as said flywheel rotates.

2. A toy vehicle as set forth in claim 1 wherein said switch means are operable to energize said motor when said vehicle body is moved from its first position.

3. A toy vehicle as set forth in claim 2 wherein said shift means includes means engaging said switch means to activate said motor when said gear drive means couple said motor to at least one of said axles.

4. A toy vehicle as set forth in claim 3 wherein said engine sound producing means includes:

a sound drum and drum head producing a sound when struck;

a flexible reed having a fixed end and a flexing end, said reed being near or in contact with said drum head in its unflexed position; and tab means coupled to said flywheel for flexing and releasing said reed to cause it to strike said drum head as said flywheel rotates.

5. A toy vehicle as set forth in claim 4 wherein said tab means include a rotatable member coupled to said flywheel and having at least one extending tab.

6. A toy vehicle as set forth in claim 5 wherein said pair of axles are supported at the front and rear of said chassis and wherein said front supported axle is pivotally secured to said chassis.

* * * * *